United States Patent [19]

Lange

[11] Patent Number: 4,557,521

[45] Date of Patent: Dec. 10, 1985

[54] CHAIR HAVING A RESILIENTLY INTERCONNECTED SEAT AND BACK

[75] Inventor: Gerd Lange, Kapsweyer, Fed. Rep. of Germany

[73] Assignee: Gebr. Thonet GmbH, Frankfurt am Main, Fed. Rep. of Germany

[21] Appl. No.: 444,070

[22] Filed: Nov. 24, 1982

[30] Foreign Application Priority Data

Dec. 7, 1981 [DE] Fed. Rep. of Germany ..... 3148393
Oct. 26, 1982 [DE] Fed. Rep. of Germany ..... 3239634

[51] Int. Cl.[4] ..... A47C 5/12; A47C 7/44

[52] U.S. Cl. ..... 297/285; 297/286; 297/306; 297/457

[58] Field of Search ..... 297/285, 286, 296, 297, 297/299, 300, 306, 457

[56] References Cited

U.S. PATENT DOCUMENTS

| | | | |
|---|---|---|---|
| 1,422,915 | 7/1922 | Benson et al. | 297/457 X |
| 2,064,137 | 12/1936 | Zerbee | 297/300 |
| 2,480,310 | 8/1949 | Torrey | 297/457 X |
| 2,745,468 | 5/1956 | Kramer | 297/285 |
| 3,243,234 | 3/1966 | Fehlner | 297/457 |
| 3,669,496 | 6/1972 | Chisholm | 297/457 X |
| 3,942,836 | 3/1976 | Baker | 297/457 X |
| 4,032,190 | 6/1977 | Muller-Deisig et al. | 297/300 X |
| 4,088,367 | 5/1978 | Atkinson et al. | 297/457 |
| 4,131,315 | 12/1978 | Vogtherr | 297/286 |
| 4,189,180 | 2/1980 | Klein | 297/453 |

FOREIGN PATENT DOCUMENTS

| | | | |
|---|---|---|---|
| 805679 | 5/1951 | Fed. Rep. of Germany | 297/296 |
| 1064220 | 8/1959 | Fed. Rep. of Germany | 297/297 |
| 2347666 | 4/1974 | Fed. Rep. of Germany | 297/DIG. 2 |
| 251033 | of 1929 | Italy | 297/306 |

*Primary Examiner*—William E. Lyddane
*Assistant Examiner*—Peter R. Brown
*Attorney, Agent, or Firm*—Browdy and Neimark

[57] ABSTRACT

In this chair a rounded spring element (128) formed with substantially U-shaped cross-section is provided which comprises parallel legs and with which a seat area (130) and/or a back (142) can be integrated. The spring element consists of plastic and is made single-walled in the curvature region, then dividing in the direction of the seat area and the back into a double-walled form. For reinforcement, ribs (148) may also be provided. At the lower side of the seat area and the double-walled portion of the spring region (128) an integrated socket for a support frame is formed. On the seat area (130) a cushion (174) may be secured with the aid of a stirrup member (136) driven into sockets (140) and comprising wood or steel tube or integral foam. The back consists for example of a cushion support (142) to which a cushion (144) is secured via a stirrup member (146) driven into sockets (152) on the spring region. It is possible to make the spring region (128), seat area (130) and back (142) from uniform material. Arm rests may be secured to the stirrup members of the cushions.

22 Claims, 15 Drawing Figures

CHAIR HAVING A RESILIENTLY INTERCONNECTED SEAT AND BACK

The present invention relates to a chair or the like having a seat area, a back resiliently connected to the seat area and a support frame.

A seat is known (DE-GM No. 1,691,799) which is resilient at the back and in which the seat area and back are made integrally, and which consists of layers glued together to form a plywood shell, the surface connecting the seat area to the back being constricted. For manufacturing reasons, said plywood shell has a uniform wall thickness. As a result, the L-shaped cross-sectioned spring region between the seat area and the chair back can only be influenced in its properties to a limited degree. In addition, with its grain directions, which exhibit a tendency to split or bend, the material wood permits only a limited deformation. The strength of the known plywood shell depends on the quality of the gluing of the layers to each other. Furthermore, a disadvantage of the known chair is that the plywood shell is difficult to connect to the subframe and this can be done only with additional parts.

DE-AS No. 1,282,261 discloses a chair of plywood in which the seat area and back are joined via a connection portion extending over the entire width. This portion, which is of substantially V-shaped cross-section, does not permit any resiliency of the chair back because of the curvature formed in several directions for stability reasons.

The invention is based on the problem of providing a chair or the like in which the spring properties of the back are adjustable and influenceable within certain limits, in which no strength problems occur, in which the connection to the support frame affords no difficulties and which can be made economically.

According to the invention the solution of this problem is characterized in that between the seat area and back a spring region of substantially U-shaped cross-section is disposed over the entire width of seat area and back, and that the spring region extends beyond the intersection line of seat area and back.

In a further development of the invention the spring region can consist of plastic and be made single-walled and rounded. Furthermore, the centre plane of the spring region can be inclined about 45° to the horizontal. By displacing the turning and rolling region rearwardly a favourable pivot behaviour is obtained for the chair back. The chair back during a resilient movement is guided horizontally and does not drop rearwardly as with the known chair. Because of the formation of the spring region from plastic and its specific form the spring region can be better controlled and the rising line of force more easily limited. Due to its semi-circular form the spring region is larger in development and peak stresses are distributed more favourably. The spring region curved in one direction is made as wide as the seat area or back, which is made possible by the choice of plastic material. The position of the spring region between seat area and back or the connection ends for seat area and back also permits shaping the base member, injection molded from plastic, for the chair in the direction of the centre plane of the spring region. This gives a relatively economical manufacture of the tool or die.

According to a preferred embodiment the legs of the spring region extend substantially parallel to each other and the ends of the legs diverge and extend substantially at right-angles to each other. This gives a favourable location with respect to the seat area and back area so that in the normal position the latter are aligned substantially at right-angles to each other. The main part of the spring action lies in the rounded base of the spring region so that an exactly controlled spring path of the back is possible.

If in a further development the spring region is made double-walled at the leg ends and provided with reinforcing ribs the 'two-dimensional' single-walled spring region (curvature about one axis) merges at both ends into the third dimension so that the ends terminate double-walled and are reinforced and can well accommodate the force to be transmitted from the seat area and chair back.

According to a further embodiment, the seat area and/or the back may be made integrally in uniform material with the spring region. This makes it possible to provide a chair or the like made from one piece which however in contrast to the known plywood shell chair has the advantages of greater strength and improved spring properties.

If the seat area and back are not made integrally with the spring region, it is possible for sockets for the back and seat area to be provided on the spring region. This enables a connection of the individual parts together with simple means.

In a further development of the invention a socket for the support frame may be formed at the lower side of the seat area and at the lower side of the horizontal reinforced leg portion of the spring region. In this integrated socket a support column can be secured in stable manner with the simplest means, for example with a cone. The socket is formed integrally at the lower side of the seat and spring portions and corresponds to the suitable sub-frame. A seat support may also be disposed between the support column and seat area.

Depending on the optical impression desired the seat area may be provided with a cushion, the cushion held by a stirrup member and the stirrup member inserted into sockets on the spring region. Also, the back may consist of a cushion support, a cushion and a stirrup member inserted into sockets on the spring region.

According to a further embodiment the seat area and/or the back may have a cushion or a cushioning of integral foam which are inserted with pins in sockets on the spring region.

Depending on the intended use a central column or a bench support may be secured in the socket at the lower side of the seat area, preferably formed as conical hole. This makes the chair suitable as office chair or for chair or seat arrangements in a hall or the like. Furthermore, at the lower side of the seat area receiving grooves for a tubular frame may be formed.

According to a further preferred embodiment at the lateral edges of the spring region sockets for arm rests are formed, and the arm rests may be substantially rectangular with three corners, the corners representing spring zones. This permits a parallelogram movement of the arm rests, the resiliency between seat are and chair back not being impaired. Likewise, the formation of the three spring zones does not impair the lateral stability of the arm rests.

To enable one arm rest form to the used both for the right and for the left arm rest, the arm rests may be made symmetrically about the diagonal through the one corner and the corner resulting from the extension of the side portions inserted in the sockets.

The arm rest may be provided at the ends of the free sides with rings throught which the ends of stirrup members disposed on the seat area and back are inserted.

Depending on the embodiment, the stirrup members with which the cushions are held on the seat area or the chair back may consist of wood, metal or plastic. The arm rests may consist of uniform material or of plastic with a metal insert.

The invention will be explained in detail with the aid of several examples of embodiment with reference to the drawings, wherein.

Figure 11:
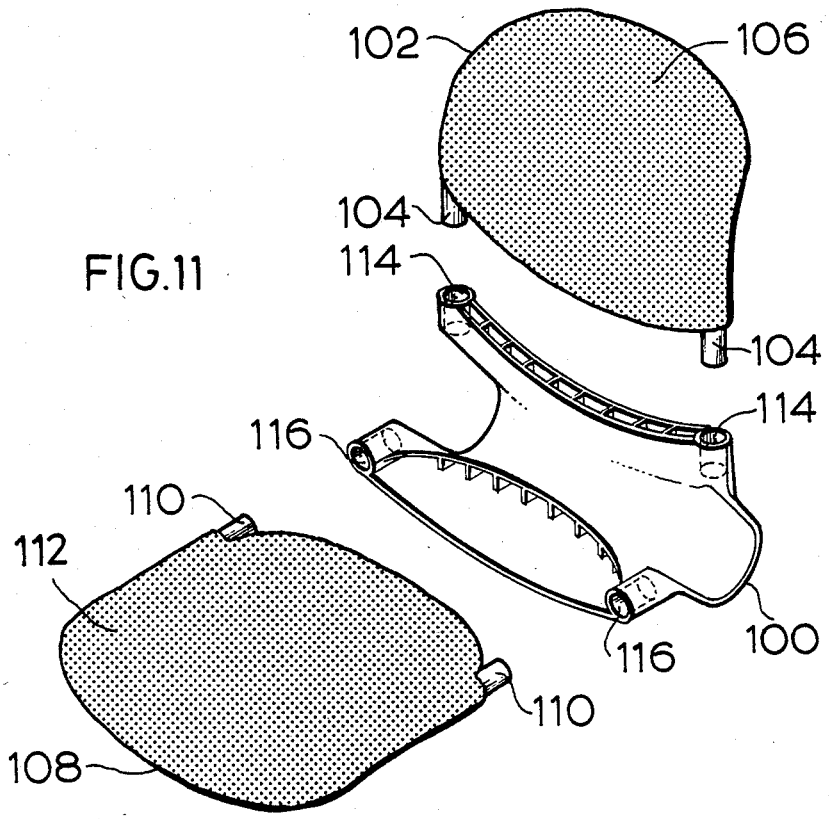
Figure 12:
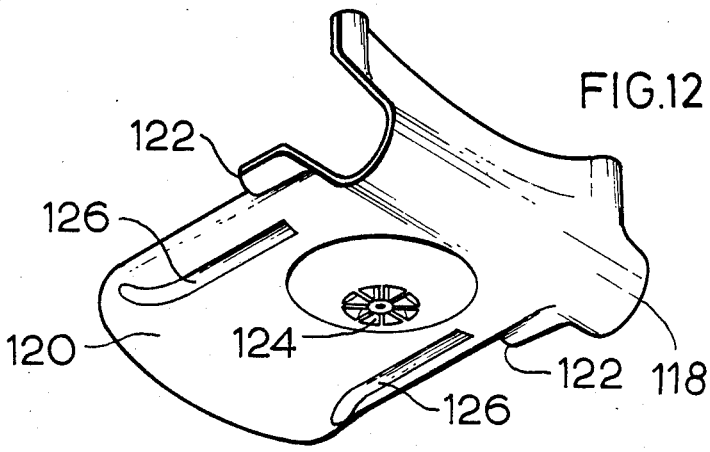
Figure 13:
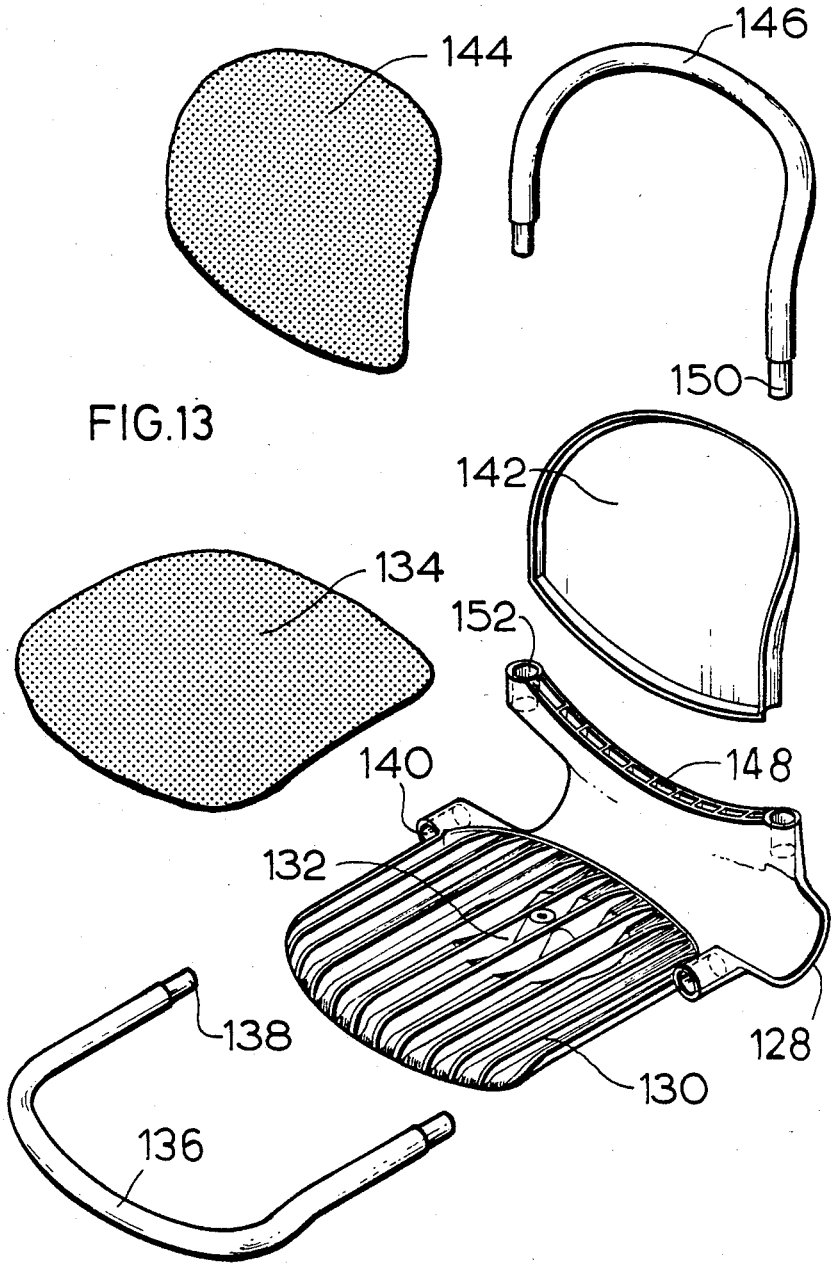
Figure 14:
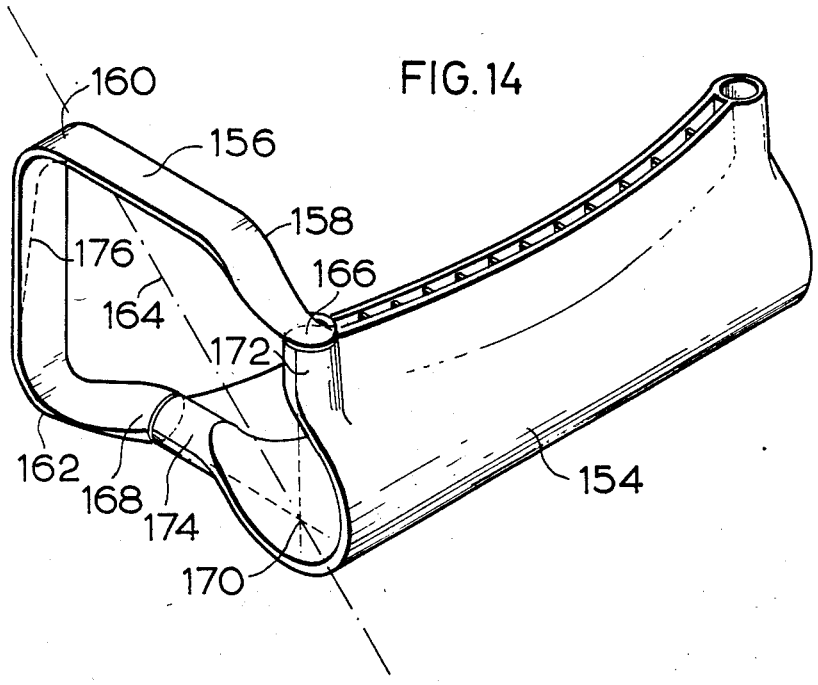
Figure 15:
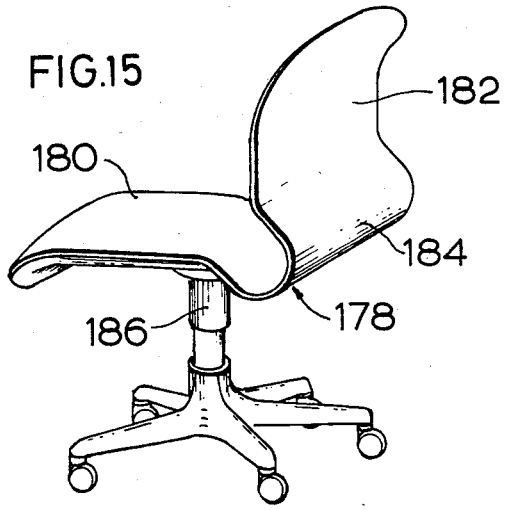

FIG. 11 is a perspective explosive illustration of an example of embodiment of a chair, FIG. 12 is a perspective illustration of a chair seen from below without support frame, FIG. 13 is a perspective illustration of a further example of embodiment of a chair, FIG. 14 is a perspective illustration of a spring region with an arm rest and FIG. 15 is a perspective illustration of a chair made integrally of uniform material.

Figure 1:
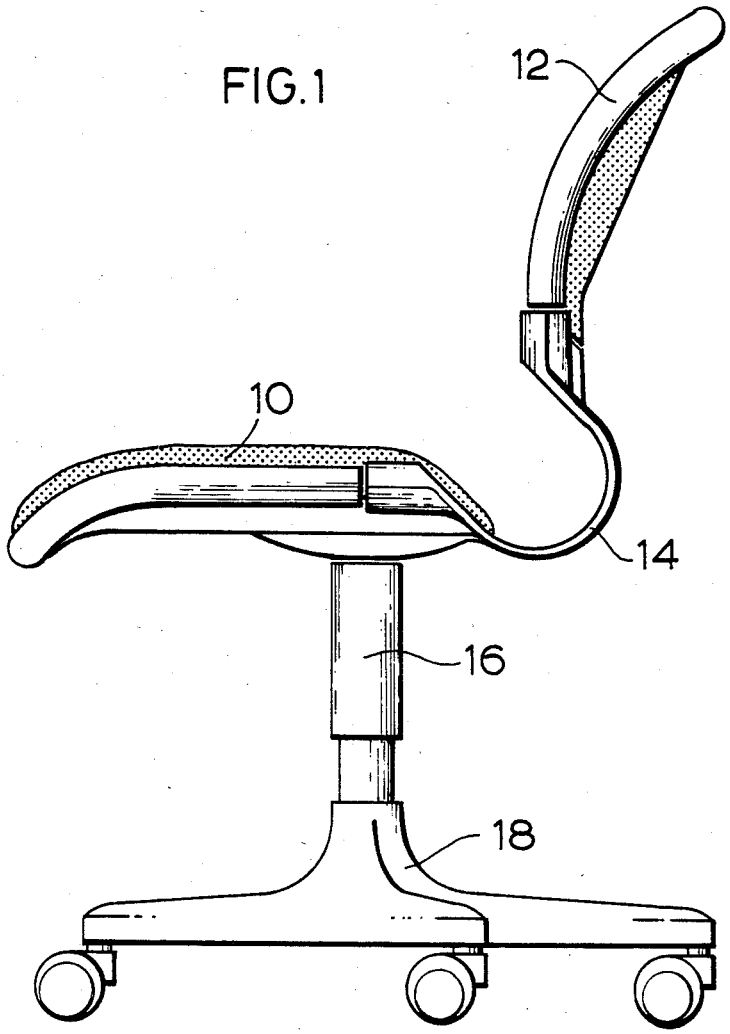
FIG. 1 shows an office chair in side elevation.

FIG. 1 shows a chair or the like, which can be used for example as office chair, having a seat area 10, a back 12 and a spring region 14 which is disposed between the seat area and the back and which extends over the entire width of the seat area and back. A support frame having a central column 16 with a five-armed roller star 18 is attached to the lower side of the seat area 10.

Figure 2:
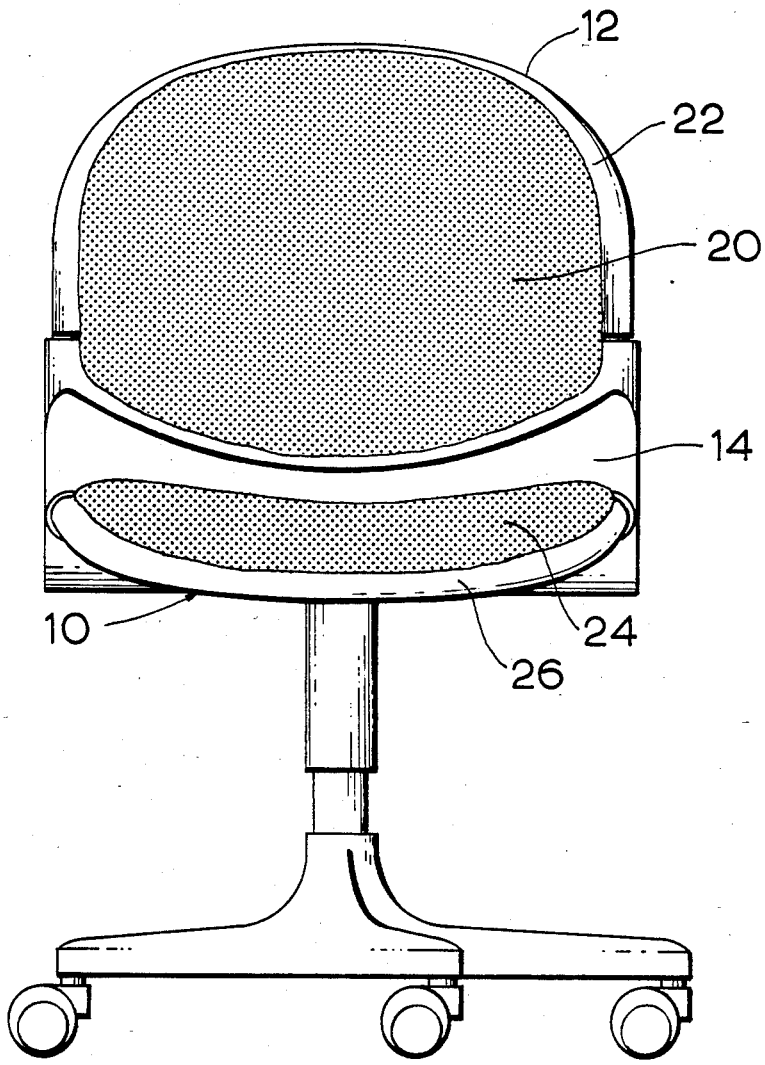
FIG. 2 shows the chair of FIG. 1 from the front.

FIG. 2 shows the chair of FIG. 1 in front elevation. It can be seen therefrom that the back 12 consists of a cushion member 20 and a stirrup member 22 surrounding said cushion member 20. The seat area 10 is formed from a cushion member 24 and a securing stirrup member 26.

Figure 3:
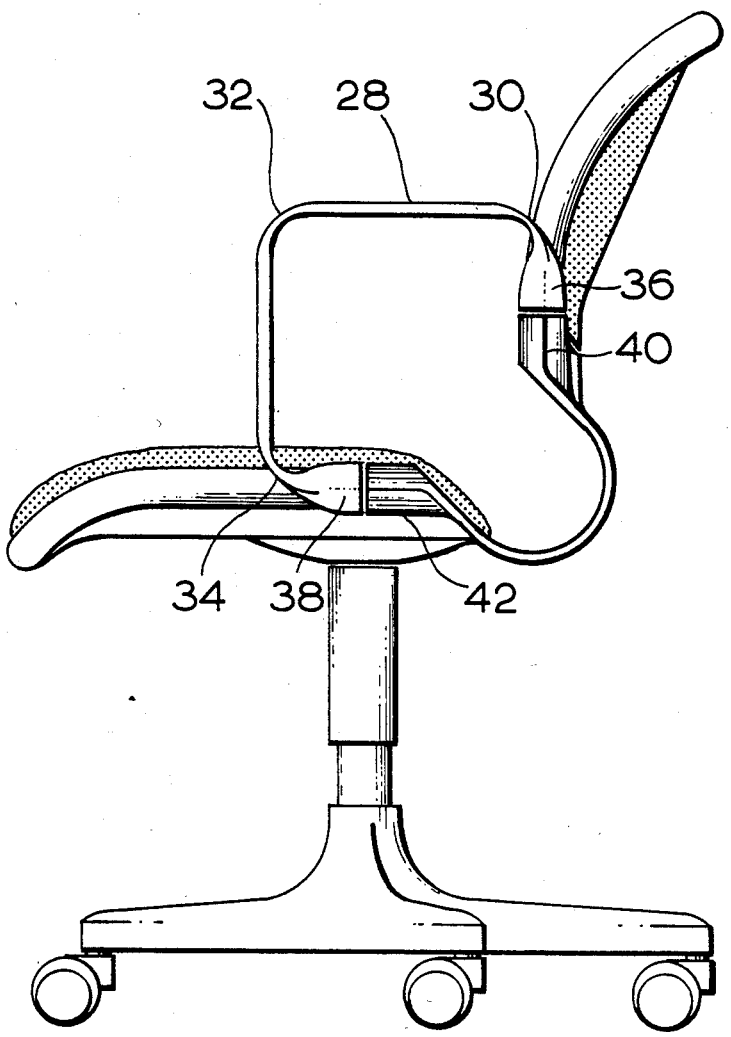
FIG. 3 shows the chair of FIG. 1 in modified form with arm rests.

FIG. 3 shows in modified form the chair of FIG. 1 in side elevation. Secured to the spring region 14 is an arm rest 28 which is made rectangular and has three corners 30, 32 and 34. Short sides 36 and 38 are plugged into sockets 40 and 42 which are formed on the spring region 14.

Figure 4:
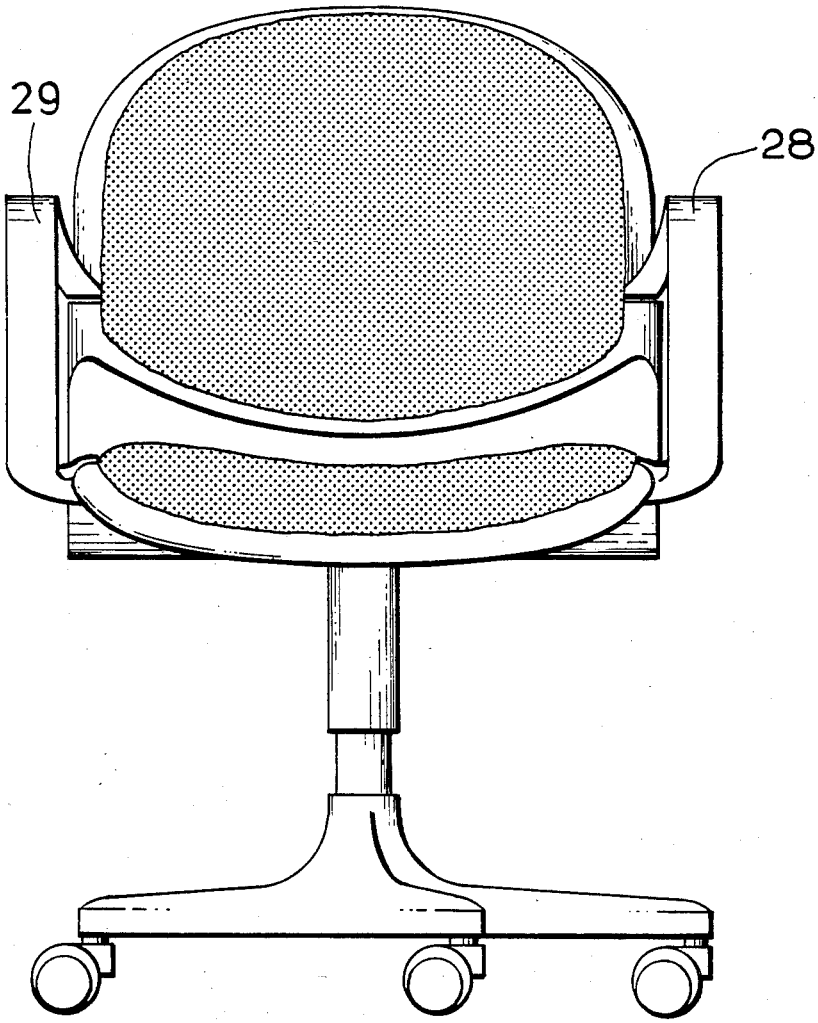
FIG. 4 shows the chair of FIG. 3 from the front.

FIG. 4 shows the chair of FIG. 3 in front elevation with the one arm rest 28 and a second arm rest 29 disposed correspondingly on opposing sides of the chair.

Figure 5:
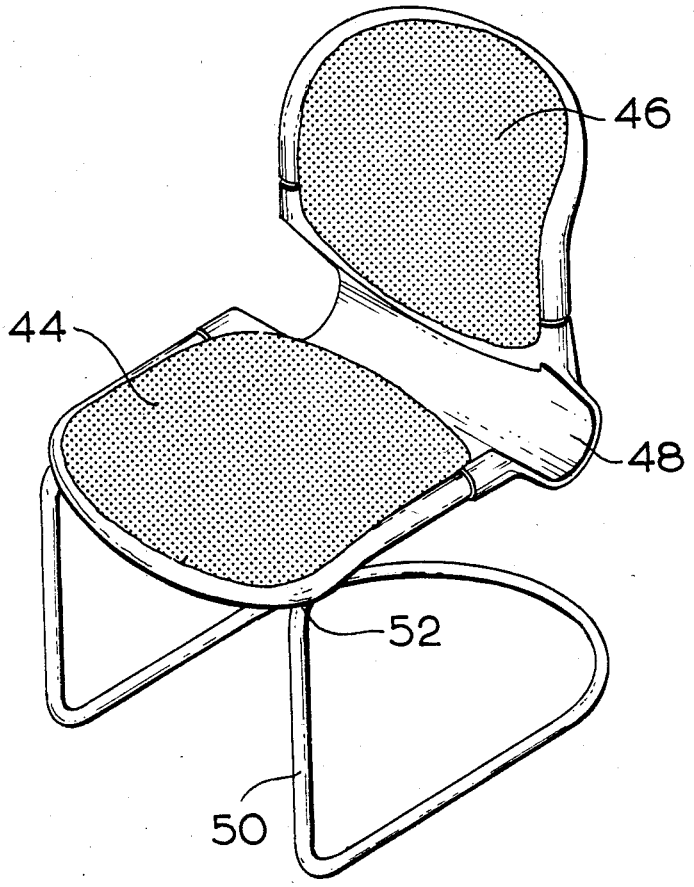
FIG. 5 shows a further example of embodiment of a chair.

FIG. 5 shows a chair also consisting of a seat area 44, a back 46 and a spring region 48, which is not however supported by a central column but by a tubular frame 50 whose upper struts 52 are secured to the lower side of the seat area 44 lying in grooves.

Figure 6:
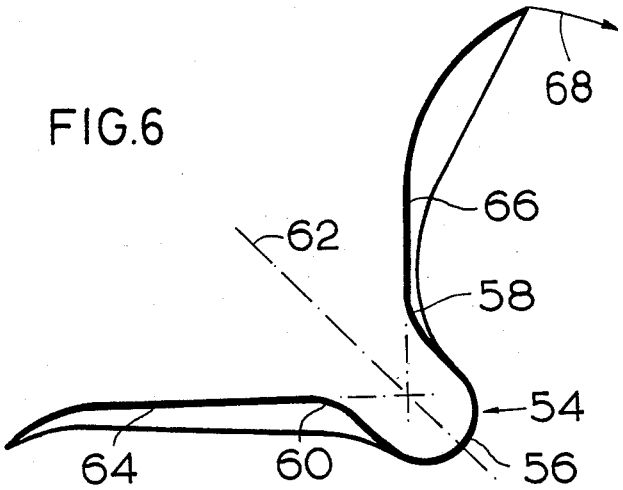
FIG. 6 is a schematic illustration of a spring region with seat area and back.

FIG. 6 is a diagrammatic illustration in side elevation of a chair without support frame. The specifically formed spring region is particularly clear from this illustration. Said spring region 54 consists for example of plastic and is made single-walled. In cross-section the spring region has a substantially U-shaped form with parallel legs and rounded base 56. The base 56 is made substantially semi-circular. This semi-circular form makes the spring region larger in development and for this reason peak stresses can be distributed more favourably. The ends 58 and 60 of the legs of the spring region 54 diverge and extend approximately at right-angles to each other. A centre plane 62 through the spring region 54 is inclined about 45° to the horizontal. The base 56 of the spring region 54 projects rearwardly beyond the line of intersection of seat area 54 and back 66. This extends rearwardly the turning and rolling area of the resilient back. On resilient movement in the direction of the arrow 68 the back is guided substantially horizontally and does not drop rearwardly as with known chairs. This permits an improved pivot behaviour of the back. When a person sitting on the chair sits upright or leans forwards a greater freedom results in the region of the intersection of seat area and back so that, for example, a jacket cannot be pinched therebetween.

Figure 7:
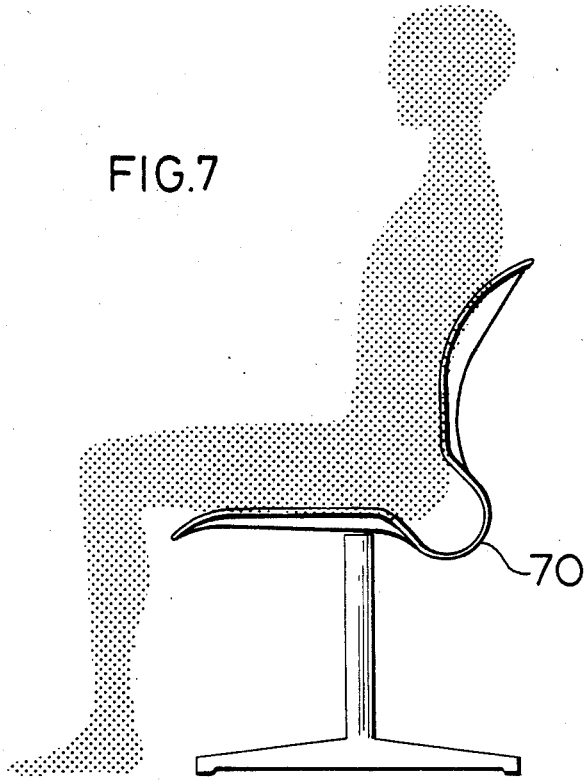
FIG. 7 is a side elevation of a chair with a person sitting thereon.

FIG. 7 shows a chair 70 comprising a spring region with a person sitting in an ergonometrically favourable position thereon. Since the legs of the spring region extend parallel to a plane inclined at 45°, an integrated chair body formed from plastic can be shaped employing a relatively simple injection mold.

Figure 8:
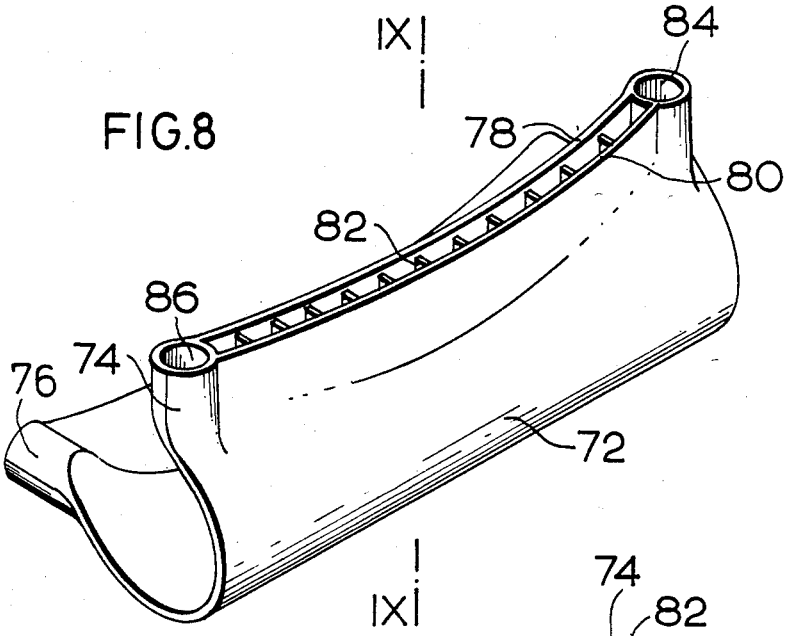
FIG. 8 is an enlarged perspective illustration of a spring region.

FIG. 8 shows in perspective illustration a spring region 72. In the central curvature region the spring member is made single-walled over the entire width of the chair and the ends of legs 74 and 76, which are aligned substantially at right-angles to each other, are split to form double-walled zones. Between walls 78 and 80; the back ribs 82 may be provided which contribute to stiffening the end regions of the spring member. Provided at the side faces are sockets 84 and 86 in which stirrup members of the back cushion can be received. The leg region 76 of the spring region adjoining a seat surface is made analogously.

Figure 9:
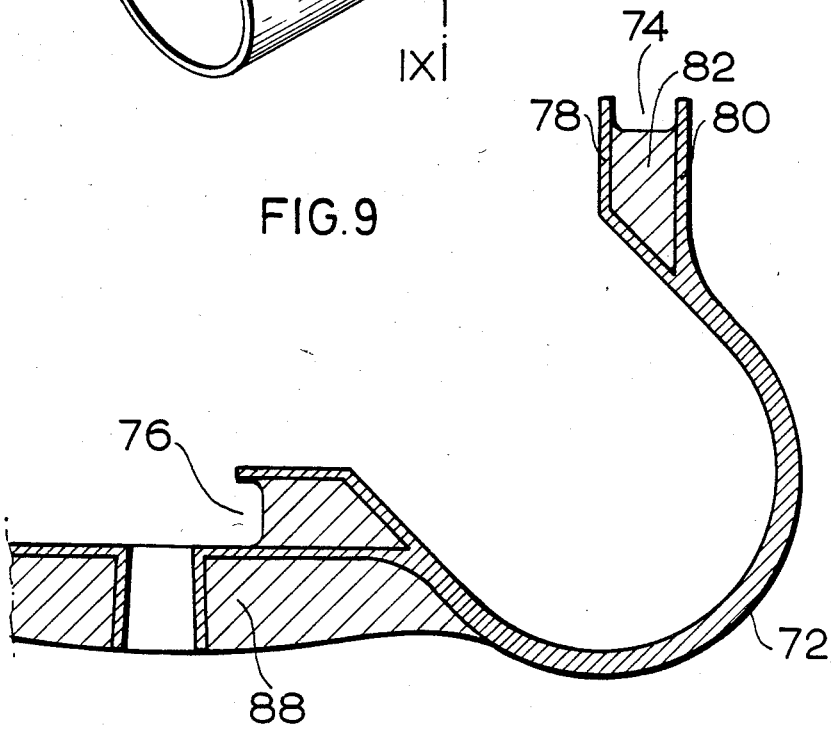
FIG. 9 is a section along the line IX—IX of FIG. 8.

FIG. 9 shows a section through the spring member 72 from which in the leg region 74 the walls 78 and 80 can be seen with the ribs 82 lying therebetween. Beneath the leg region 76 an integral seat support 88 can be seen which serves for example to accommodate a central column.

Figure 10:
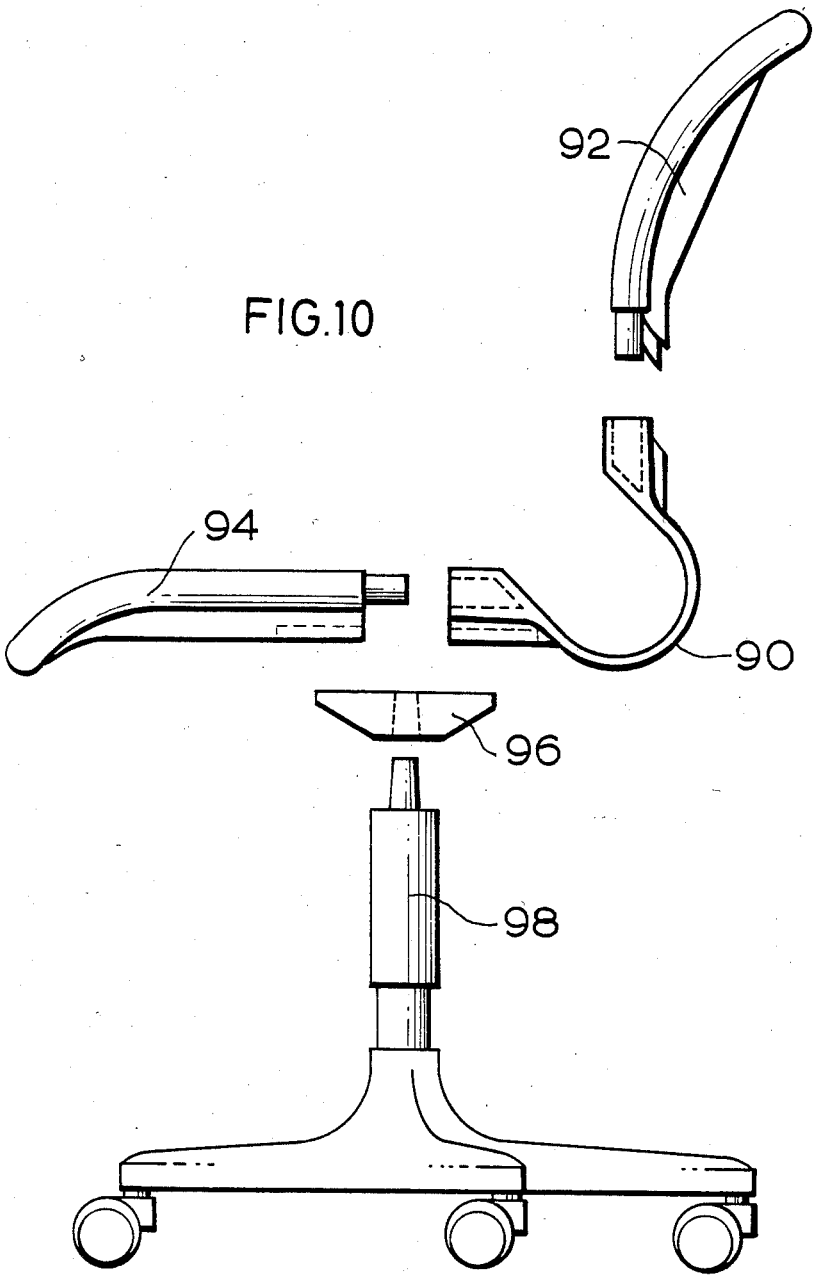
FIG. 10 is an explosive illustration of a chair or the like seen from the side.

FIG. 10 shows in explosive illustration from the side a chair having a spring member 90, a back 92, a seat area 94, a seat support 96 and a central column 98. Formed on the spring member 90 are sockets for the back and seat area.

FIG. 11 shows in explosive illustration an embodiment of a chair having a spring region 100, a back 102 consisting of a cushion 106 stretched on a stirrup member 104, and a seat area 108 which is made up of a stirrup member 110 with a cushion 112 mounted thereon. The ends of the stirrup members 104 and 110 are inserted in sockets 114 and 116 respectively. For a secure joining of the back or seat area to the spring member further plug means can be formed on the areas of contact thereof. The seat area 108 may also be formed as integral part with a metal skeleton.

FIG. 12 shows a spring region 118 on which a seat area 120 is integrally formed. The spring region 118, made single-walled in the curvature region, divides in the end regions or a transition region to the seat area in double-walled manner and forms with the seat area a rigid unit. On the sides, sockets 122 are provided for abutment edge stirrup members of a cushion or for an arm rest. Provided at the lower side of the seat area or of the double-walled portion of the spring region is an integrated socket 124 for a central column or for a bench support. This socket is provided for example with ribs which serve to reinforce and clearly locate the support frame. Disposed laterally at the lower side of the seat area and the double-walled portion of the spring region are receiving grooves 126 which serve to receive a tubular frame corresponding to FIG. 5. The chair or the like according to FIG. 12 consists of a spring region with integrated seat area. Likewise, it would be possible to make the spring region with integrated back or make the spring region both with integrated seat area and with integrated back.

FIG. 13 shows in perspective explosive illustration a chair having a spring region 128 which is connected integrally to a seat area 130. Beneath the seat area and the spring region an integrated seat support 132 is provided. At the upper side the seat area is formed with reinforcement ribs which start in the dividion region of the otherwise single-walled spring region and extend upto the front edge of the seat area. By the ribs, whilst saving a large amount of material, a stiff seat area is provided whose production is economical due to the ease formability. The spring action of the spring region is optimally set by the ribs and the seat support. On the ribs of the seat area 130 a cushion 134 is disposed which is held on the chair by means of an abutment edge stirrup member 136. The stirrup member 136 is inserted for this purpose with its ends 138 in sockets 140 on the spring region. A back is made up of a cushion support 142, a cushion 144 and an abutment edge stirrup member 146. The cushion 144 is secured on the cushion support 142 and thereafter said support is placed on the vertical leg 148 of the spring region 128 and the cushion support and cushion are secured via the abutment edge stirrup member 146 to the spring region 128, the ends 150 of the stirrup member 146 being inserted or driven into sockets 152 on the spring element. For securing the cushion support of the back, on said support openings may be formed and corresponding pins formed on the divided leg end of the spring region. After securing the central column, not illustrated, the result is a chair with excellent sitting and springing properties.

FIG. 14 shows a spring region 154 to which an arm rest 156 is attached similarly to FIGS. 3 and 4. The arm rest 156 is substantially rectangular in side elevation and comprises three corners 158, 160 and 162, the corners being constructed as spring zones. This means that when the position of the chair back changes the arm rest acts as parallelogram so that said rest can follow the movement of the spring region. The lateral stability of the arm rest is not impaired. The arm rest may consist of a uniform material or for example of polyurethane material with a metal insert. To enable the same rest to be attached on the right or on the left said rest is made symmetrical about a diagonal 164 which extends through the corner 160 and an imaginary corner 170 formed by the extension of the sides 166 and 168. The ends of the sides 166 and 168 are inserted into sockets 172 and 174 on the spring element 154. A dashed line 176 shows the parallel displacement of the arm rest 156 on resilient displacement of a chair back which is not illustrated. The stirrup members, for example 136 and 146, serving to secure the cushions of seat areas or backs, consist of wood, steel tube or an integral foam. The arm rests may be constructed at the free side ends with rings with which they can be fitted to the stirrup members for securing the cushions. This makes it possible to secure the arm rests without additional provisions to the spring region and likewise possible to remove them without unused mounting points then being visible.

FIG. 15 shows a chair or the like 178 constructed as office chair in which the seat area 180 and the back 182 are molded integrally with the spring region 184 from the same plastic material. A central column 186 is secured in the transition region between the seat area 180 and spring region 184. The seat area 180 and back 182 may be provided with a cushioning.

I claim:

1. Seat furniture having a seat portion, a support frame for supporting the seat portion, and a back portion located rearwardly of said seat portion, comprising:

U-shaped means for resiliently interconnecting said seat portion with said back portion, said interconnecting means comprising a first leg having a width corresponding to the width of the back portion a second leg having a width corresponding to the width of said seat portion, and means, unitarily joining said first leg with said second leg, for preventing movement of the back portion downwardly when rearwardly directed forces are applied to said back portion, said preventing means having a semi-circular cross-section, each of said first and second legs having a first portion connected tangentially with said preventing means and extending parallel with one another, and a second portion unitary with said first portion which diverges from, and extends substantially at right-angles to, said first portion, and each of said first and second legs second portions extending coextensively with said back portion and said seat portion, respectively.

2. Seat furniture according to claim 1, wherein said preventing means consists of plastic and is single-walled.

3. Seat furniture according to claim 1, wherein said preventing means includes a plane of symmetry inclined about 45° to the horizontal.

4. Seat furniture according to claim 1 wherein said legs are double-walled and formed with reinforcing ribs.

5. Seat furniture according to claim 1, wherein at least one of said seat portion and said back portion comprise uniform material and is formed integrally with said preventing means.

6. Seat furniture according to claim 1, wherein said legs include sockets for the back and the seat portions.

7. Seat furniture according to claim 1, wherein the lower side of said seat portion includes a socket for the support frame, said socket being formed at the lower side of said second leg.

8. Seat furniture according to claim 7 and further including a central column or bench support disposed between said support frame and said socket.

9. Seat furniture according to claim 1, wherein said seat portion includes a cushion and a stirrup member, said stirrup member supporting said cushion and having ends inserted into sockets carried by said second leg.

10. Seat furniture according to claim 9, wherein said stirrup member consists of one of the group of wood, metal or plastic.

11. Seat furniture according to claim 1, wherein said back portion comprises a cushion support, a cushion, and a stirrup member inserted into sockets carried by said first leg.

12. Seat furniture according to claim 11, wherein said stirrup member consists of one of the group of wood, metal or plastic.

13. Seat furniture according to claim 1, wherein at least one of said seat portion and said back portion comprise a cushion member having pins insertable into sockets carried by at least one of said second and first legs, respectively.

14. Seat furniture according to claim 1, wherein the lower side of said seat portion comprises grooved means for receiving a tubular frame.

15. Seat furniture according to claim 1, wherein the lateral edges of said first and second legs include sockets for receiving arm rests.

16. Seat furniture according to claim 15, and further including arm rests engaged in said sockets of the first and second legs.

17. Seat furniture according to claim 15, wherein said arm rests are substantially rectangular with three corners, the corners being formed as spring zones.

18. Seat furniture according to claim 15, wherein said arm rests are symmetrical with respect to a diagonal through the one corner and through an imaginary corner formed by extensions of side portions of said arm rests inserted into said sockets.

19. Seat furniture according to claim 15, wherein said arm rests consist of one of the group of uniform material or plastic with a metal insert.

20. Seat furniture according to claim 19, wherein said socket comprises a conical hole.

21. Seat furniture according to claim 1, wherein the support frame comprises a central column disposed beneath the seat portion.

22. Seat furniture according to claim 1, wherein the upper side of the seat portion includes reinforcement ribs.

* * * * *